United States Patent [19]

de los Santos

[11] 4,366,929

[45] Jan. 4, 1983

[54] PROCESS AND APPARATUS FOR GRINDING MATERIALS

[76] Inventor: Federico de los Santos, Villa Ol'impica, Edificio 17, Depto. 302, México 22, D.F., Mexico

[21] Appl. No.: 145,739

[22] Filed: May 1, 1980

[51] Int. Cl.[3] ..... B02C 19/00

[52] U.S. Cl. ..... 241/85; 241/86.1; 241/88; 241/91; 241/152 R

[58] Field of Search ..... 241/5, 26, 27, 85, 86.1, 241/76, 88.1, 91, 79.2, 39, 187, 79.3, 188 R, 275, 284, 74, 88, 68, 30, 152 R, 299, 188 A, 278 R, 278 A

[56] References Cited

U.S. PATENT DOCUMENTS

| | | | |
|---|---|---|---|
| 2,096,274 | 10/1937 | Beach | 241/152 R X |
| 2,502,022 | 3/1950 | Paul | 241/284 |
| 2,901,188 | 8/1959 | Weleers et al. | 241/299 X |
| 3,028,105 | 4/1962 | Perrine | 241/188 R |
| 3,503,561 | 3/1970 | Johnson | 241/188 R |
| 3,659,793 | 5/1972 | Stephenson et al. | 241/187 |

*Primary Examiner*—Mark Rosenbaum
*Attorney, Agent, or Firm*—Fleit & Jacobson

[57] ABSTRACT

A process for grinding materials comprises driving a plurality of unground particles in a grinding zone in a predetermined direction, abruptly reversing the direction of motion of part of the particles in a subsequent grinding zone so that they impact with each other and reversing the direction of motion of the particles as they pass from one grinding zone to the next, until the size of the particles is reduced to the desired level. A grinder for carrying out such process essentially comprises first and second rotors, the first rotor being provided with a plurality of first perforate members and the second rotor being similarly provided with a plurality of second perforate members alternately arranged between each pair of first perforate members. The first rotor is rotatable in a predetermined direction, while the second rotor is rotatable in the opposite direction. Material is discharged within the central portion of the rotors; and discharge device is communicated with the periphery of the rotors, so that the material fed to the innermost perforate member of one of the rotors is centrifugally thrown towards the innermost perforate member of the other rotor through the bores thereof and so forth, in order to repeatedly reverse the direction of rotation of the material and cause the particles to impact with each other in order to effect a grinding action.

4 Claims, 5 Drawing Figures

PROCESS AND APPARATUS FOR GRINDING MATERIALS

FIELD OF THE INVENTION

The present invention refers to the art of grinding materials and, more particularly, it is related to a novel grinding process and a novel grinding apparatus for carrying out said process, wherein the materials are ground by impacts between the particles themselves without abrading the metal parts of the apparatus.

BACKGROUND OF THE INVENTION

In the prior art techniques for grinding materials, a great diversity of well known systems and processes are used, among which there may be mentioned those that are based on the impact of certain mechanical members of the grinders (such as in hammer mills) and the particles of the material which is to be ground, in order to break said particles until the desired fineness is obtained, as well as those in which the materials are impacted against particles of very hard materials (such as in ball mills), in order to achieve the grinding of said particles of material, and also those which operate by rubbing or attrition (attrition or rubbing mills) wherein a pair of mill wheels or grind stones are rubbed against each other and against the particles of the material in order to comminute the same.

In more recent times other types of grinding systems have been developed wherein apparatus are provided which are capable of building up a layer of the same material on the impact surfaces thereof, such that the moving particles of the material will impact, not against the moving members of the grinder but, on the contrary, against the layers of material formed and deposited thereon, whereby the duration of the operational members of the grinders is greatly increased, inasmuch as in this instance the particles of material to be ground are impacted against temporary layers previously built up with the material which is being ground, thereby effecting the grinding operation through impacts of the materials themselves, rather than through impact of said materials against abradable members of the grinder.

Finally, grinding systems are also known wherein the grinding principle is to throw the particles of material by means of high pressure air or gas, either against other particles of the material or against rigid working surfaces of the grinder.

The problems caused by the prior art grinding systems wherein the materials impact against rigid working members, either moved by the same apparatus or loose and thrown by some type of special system, are very well known and essentially reside in the low life of the working members, which must be replaced very frequently, inasmuch as the abrasive action of the materials under treatment, causes a very fast wear of said members, with the consequent economical disadvantages caused both by the replacement of said members and by the stops of the machine caused thereby.

The introduction of grinding systems in which the materials are made to impact against layers of the same material deposited on working moving surfaces, considerably improved the conditions of operation and solved the drawbacks shown by the traditional prior art grinders wherein the materials are impacted against rigid working members, inasmuch as it is the same material which receives said impact of the particles under treatment and, therefore, there is no substantial wear of the materials of which the grinder is built. However, this type of systems may be generally regarded as of a slow speed, inasmuch as the speed that may be given to the moving layers of materials is limited, in view of both static and dynamic equilibrium considerations, inasmuch as the material layers built up over the moving working surfaces, cause unequal forces that provoke high vibration of the apparatus. Therefore, it was materially impossible to solve the above problem of slow operation merely by means of increasing the speed of the moving layers of material, because the dynamic equilibrium considerations were mandatory in this type of systems and it was not possible to increase the speed indefinitely.

Therefore, a grinding principle has been for long sought that might solve the problems caused by the abrasion of the working surfaces of the grinders and, while these problems were partially solved by means of the principle which involves the building up of layers of the same material on the surfaces of the grinders which otherwise would be worn out, the solution was not quite appropriate, because a slowness factor was incorporated. Consequently, it has been the aim of the workers dealing with this problem, to device a system in order to considerably increase the speed of said working layers of material, so as to produce a very fast and easy grinding operation, without any success up to the present date.

BRIEF SUMMARY OF THE INVENTION

Having in mind the defects of the prior art grinding systems, it is an object of the present invention to provide a grinding process wherein the particles of the material to be ground are thrown alternately in opposite directions, in order that the particles may impact against each other and be ground.

It is another object of the present invention to provide a grinding process of the above mentioned character, wherein the materials to be ground are thrown against other materials of the same composition that rotate in a contrary direction, thereby causing impacts between the materials that rotate in contrary directions in an alternate and repeated manner as many times as it is desired, in order to achieve the required fineness thereof.

One other object of the present invention is to provide a grinder to carry out the above described process, which will be of a very economical construction and of a considerably increased life.

A more particular object of the present invention is to provide a grinder of the above mentioned character, wherein the particles of material are thrown in opposite rotational directions by means of the also opposite rotation of a pair of rotor members.

It is another object of the present invention to provide a grinder of the above mentioned character, in which the discharge of materials will be effected by the centrifugal force caused by rotation of the grinder itself, without the need of any special system of extraction or collection of the material.

A more important object of the present invention is to provide a grinder of the above character, which will be capable of producing impacts between the particles of material and between said particles and the layers of material built up on the working surfaces thereof, at a speed which will be nearly twice as great as the speed of said layers.

BRIEF DESCRIPTION OF THE DRAWINGS

The novel features that are considered characteristic of the present invention will be set forth with particularity in the appended claims. The invention itself, however, both as its organization and its method of operation, together with other objects and advantages thereof, will be best understood in the following detailed description of a specific embodiment, when read in connection with the accompanying drawings, wherein:

FIG. 3 is a cross-sectional elevational view taken along lines 3—3 of FIG. 1 and looking in the direction of the arrows;

DETAILED DESCRIPTION

Figure 1:
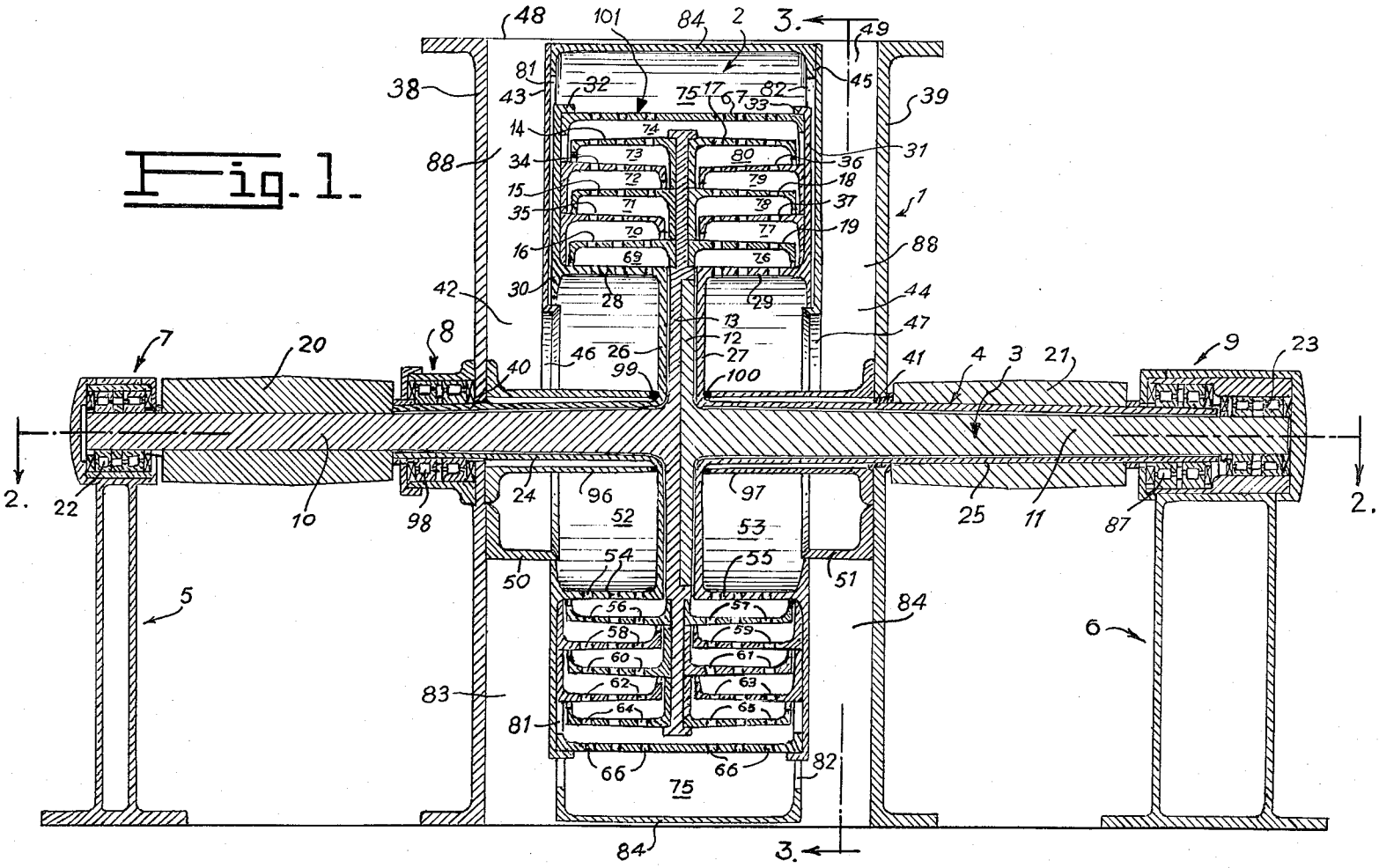
FIG. 1 is a cross-sectional side elevational view to show inner details thereof, of a grinder built in accordance with the present invention.
Figure 2:
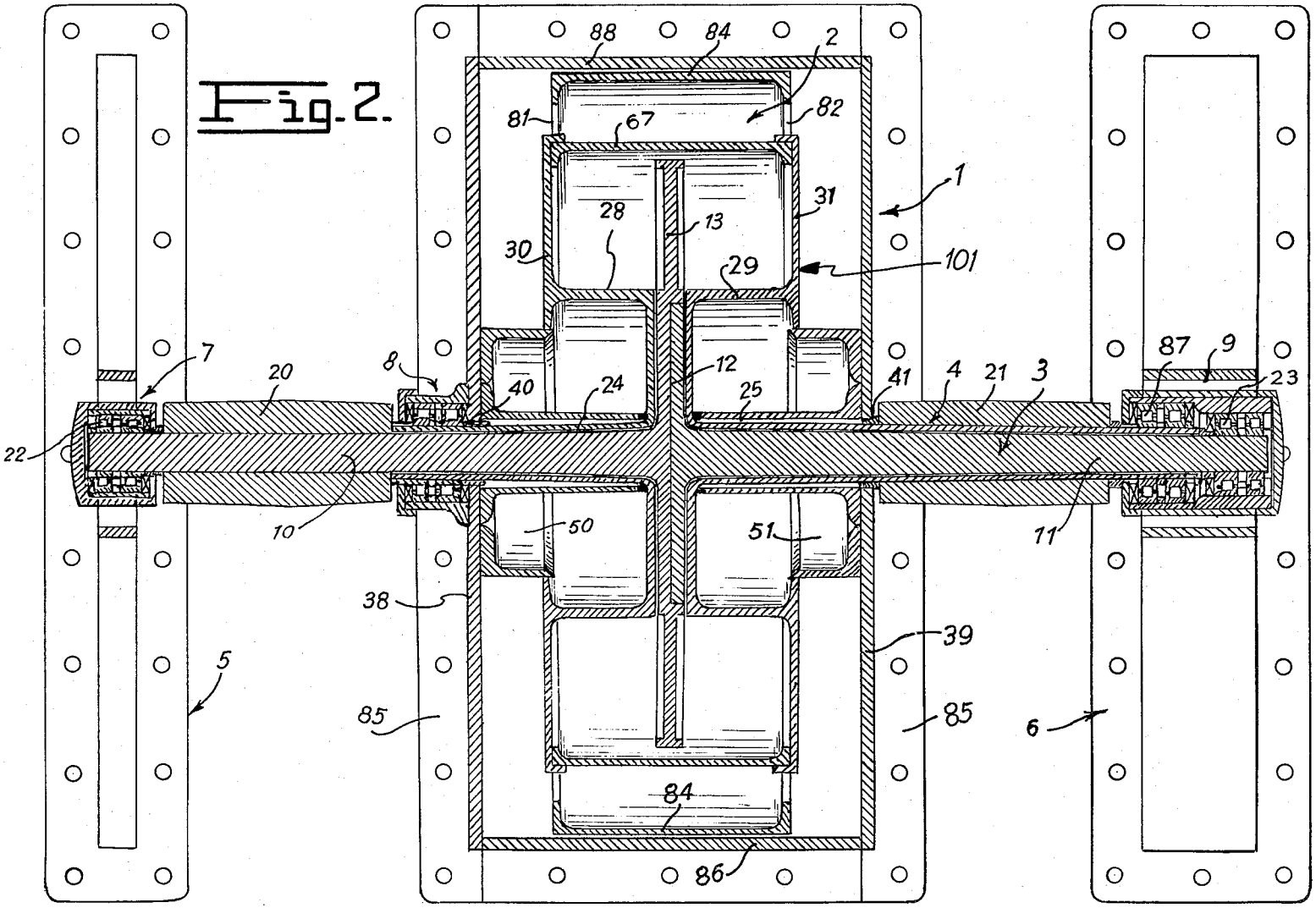
FIG. 2 is a cross-sectional view taken along lines 2—2 of FIG. 1 and looking in the direction of the arrows.
Figure 7:
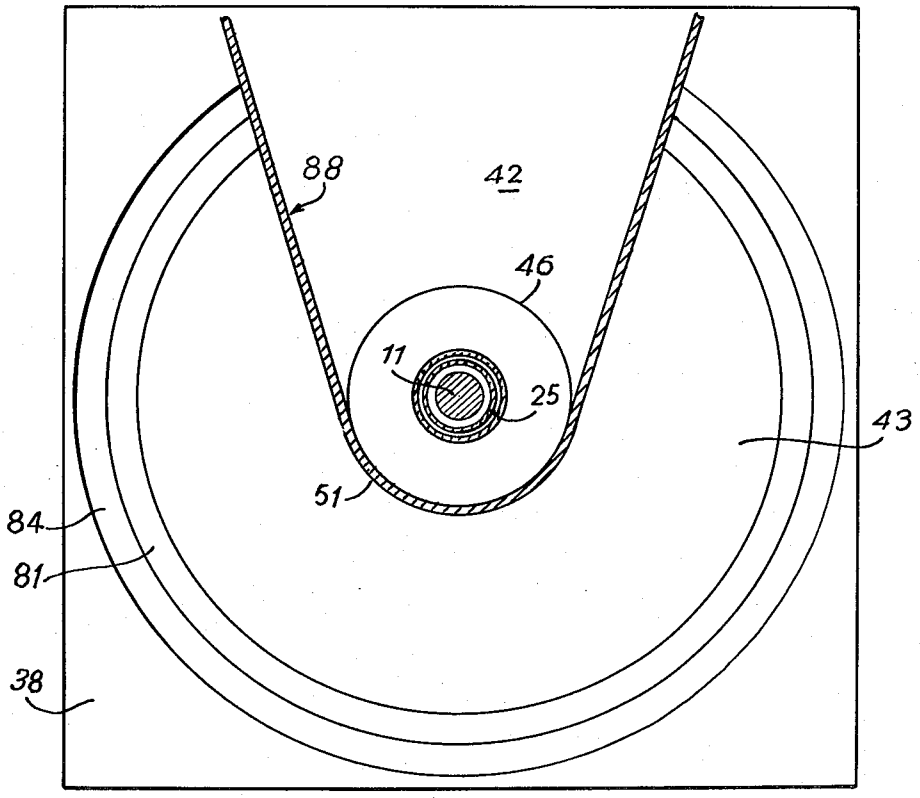

Having now more particular reference to the drawings and more specifically to FIGS. 1 and 2 thereof, there is shown a grinder built in accordance with a particularly preferred embodiment of the invention, which must be regarded only as exemplary but not as limitative thereof, and which broadly comprises an outer housing 1, an inner or rotor housing generally designated by means of the reference numeral 2 within said outer housing 1, a rotor assembly 101 which comprises two oppositely rotating rotors, one of said rotors being operated by means of a shaft assembly 3 and the other of said rotors being operated by means of a hollow shaft assembly 4 which rotates in the opposite direction with respect to shaft assembly 3 and which is concentrically spaced therefrom. Shaft assembly 3 and hollow shaft assembly 4 to operate the rotor assembly 101 are respectively journaled on top of pedestals 5 and 6 on which suitable bearings are arranged, such as is illustrated by 7 and 9 respectively, a third bearing 8 being arranged on the outer housing 1 for journalling hollow shaft assembly 4, such as it may be more clearly seen in FIG. 1 of the drawings.

One of the rotors of the grinder built in accordance with the embodiment illustrated in FIGS. 1 and 2 of the drawings, is operated by means of said shaft assembly 3 which comprises two shafts 10 and 11, the end of shaft 10 being journaled on bearing 7 which comprises a ball bearing 22 and the opposite end of shaft 11 being journaled on bearing 9 and particularly on the ball bearing 23 provided therein. A suitable pulley 20 is arranged fixedly mounted on shaft 10, in order to provide a drive which may comprise a band and a suitable motor (not shown) or any other driving mechanism in order to rotate shaft assembly 3 and consequently one of the rotors of the grinder of the present invention. Shaft 11 comprises, at its portion directed toward shaft 10, an integral disk 12, while shaft 10 is provided with a larger diameter integral disk 13, superposed to disk 12 and face to face therewith. Both disks 12 and 13 are suitably attached to each other and are provided in a separate form only for the purpose of facilitating the mounting of the rotor moved by shaft assembly 3.

On the outer portion of disk 13 supported by shaft 10, a plurality of perforate flanged grinding members in the shape of annular or hollow cylindrical channels are provided extending outwardly from both faces of disk 13. More particularly the flanged grinding members 14, 15 and 16 are directed towards the left as seen in FIG. 1, whereas the flanged grinding members 17, 18 and 19 are directed toward the right as seen in FIG. 1 of the drawings, all of said grinding members being of a hollow cylindrical shape and rotating in unison with the disk 13 driven by shaft assembly 3.

The second rotor of the grinder built in accordance with the embodiment shown, is operated by means of the hollow shaft assembly 4 which comprises two hollow shafts, namely, a left hollow shaft 24 and a right hollow shaft 25 as seen in FIG. 1. The left hollow shaft 24 rotates concentrically outwardly of shaft 10 and is journaled on ball bearing 98 arranged within bearing 8 and being of a sufficiently short length to permit the mounting of the pulley 20 on the shaft 10, as clearly illustrated in FIGS. 1 and 2. The right hollow shaft 25 rotates concentrically outwardly of the shaft 11 and is journaled on the ball bearing 87 of bearing 9, both shafts 24 and 25 of the hollow shaft assembly 4 being fixedly joined by means of the second rotor itself which will be described hereinbelow.

The hollow shaft 24 journaled on the ball bearing 98 of bearing 8, which in turn is supported by the wall 38 of the outer housing 1, at its portion directed towards the center of the apparatus, is provided with an integral disk 26, to which periphery a flanged annular or hollow cylindrical grinding member 28 is engaged, said grinding member 28 projecting outwardly thereof and towards the left as seen in FIG. 1. At the outer portion of member 28 there is provided an annular disk 30, and at the periphery of disk 30 there is provided an inwardly directed flange 32.

On the other hand, the hollow shaft 25 is supported at its outer end on the ball bearing 87 of bearing 9 and carries a pulley 21 fixedly mounted thereon, for the same purpose already described with respect to pulley 20, that is, in order to be connected to a drive which rotates this second rotor in the opposite direction with respect to the first above described rotor. The hollow shaft 25, at its portion directed towards the center of the device, is provided with a plurality of members symmetrical to the already described members for the hollow shaft 24, and comprising a disk 27, a flanged grinding member 29, and an annular disk 31 having an inwardly directed flange 33 at its periphery. Between flange 32 of disk 30 and flange 33 of disk 31, a perforate flanged annular or hollow cylindrical grinding member 67 is arranged to close the rotor described above which is operated by means of the hollow shaft assembly 4 passing through the walls 38 and 39 of outer housing 1, wherein suitable packings 40 and 41 are provided in order to avoid the escape of dust towards the exterior of the device.

The above described second rotor is also provided with a plurality of concentric perforate flanged grinding members in the shape of annular or hollow cylindrical channels extending axially inwardly of each of the annular disks 30 and 31 and alternately arranged between pairs of the corresponding grinding members of the first rotor. More particularly, the grinding members 34 and 35 extend from disk 30 and are arranged concentrically between each pair of members 14, 15 and 16, while members 36 and 37 extend from disk 31 and are arranged concentrically between each pair of members 17, 18 and 19.

All the power drive for the rotors described above, is suitably protected by means of dust guards 96 and 97 fully surrounding shaft assemblies 3 and 4 and containing, at the central opening thereof, suitable packings 99 and 100 which seal against disks 26 and 27 of the hollow shaft, to thereby also avoid contamination of the spaces corresponding to shaft assemblies 3 and 4.

The oppositely rotating rotors described above, are fully contained within the outer housing 1, which is formed by a pair of walls 38 and 39 which may be more clearly seen in FIG. 2 of the drawings, said walls being joined by means of side walls 86 and 88 to form the complete housing which may be provided in halves that thereafter will be joined by means of flanges 85 suitably bored to receive bolts thereon in order to provide for a simple assembly of the housing.

Within the outer housing 1 and also fully housing the rotor assembly, there is provided a rotor housing 2 which is more clearly illustrated in FIG. 2 of the drawings and which comprises a pair of walls 43 and 45 joined by means of a annular integral wall 84 completely surrounding the above described rotor assembly and ultimately receiving the ground material for discharge outwardly of the apparatus. Openings 46 and 47, respectively, are provided in walls 43 and 45, said openings being centrally arranged in said rotor housing 2 and preferably contain a lip such as clearly illustrated in FIG. 1 of the drawings, for the purpose of providing an inlet for unground material. The wall 84, at its periphery, is provided with radially inwardly directed flanges in order to furnish circular openings 81 and 82 which leave a sufficient space to the disks 30 and 31 of the second rotor to permit them to freely move within said housing, said openings 81 and 82 serving as the outlet for ground material to permit said material to be centrifugally driven outwardly of the rotor housing, at the lower portion of the rotor housing 2, as will be described in more detail hereinbelow.

The walls 43 and 45 of the rotor housing form, with the walls 38 and 39 of the outer housing 1, a pair of material loading chutes, such as clearly indicated at 42 and 44, respectively, said chutes having mouths 48 and 49 through which unground material may be charged to the grinder and be guided, as more clearly illustrated in FIG. 3 of the drawings, by the triangularly arranged walls 88 which form a funnel to conduct the material downwardly, said material being led by the lower parts 50 and 51 of said walls 88, in order to enter into the rotors, and particularly into the grinding chambers 52 and 53 through the openings 46 and 47 of said walls 43 and 45.

In order to suitably handle the materials within the rotors of the grinder in accordance with the present invention, the flanged grinding members of said rotors form grinding chambers such as illustrated, from the center towards the periphery, by means of the reference numerals 52, 53; 69, 76; 70, 77; 71, 78; 72, 79; 73, 80; and 74, as well as a discharge chamber 75 as will be described below.

Grinding members 14, 15, 16, 17, 18 and 19, corresponding to the rotor moved by shaft assembly 3 and grinding members 34, 35, 36 and 37 moved by the hollow shaft assembly 4 corresponding to the second rotor, contain suitable holes throughout their annular surfaces, said holes having a decreasing diameter from the center toward the periphery, for the purpose of allowing the passage of materials moving within the grinder.

Figure 4:
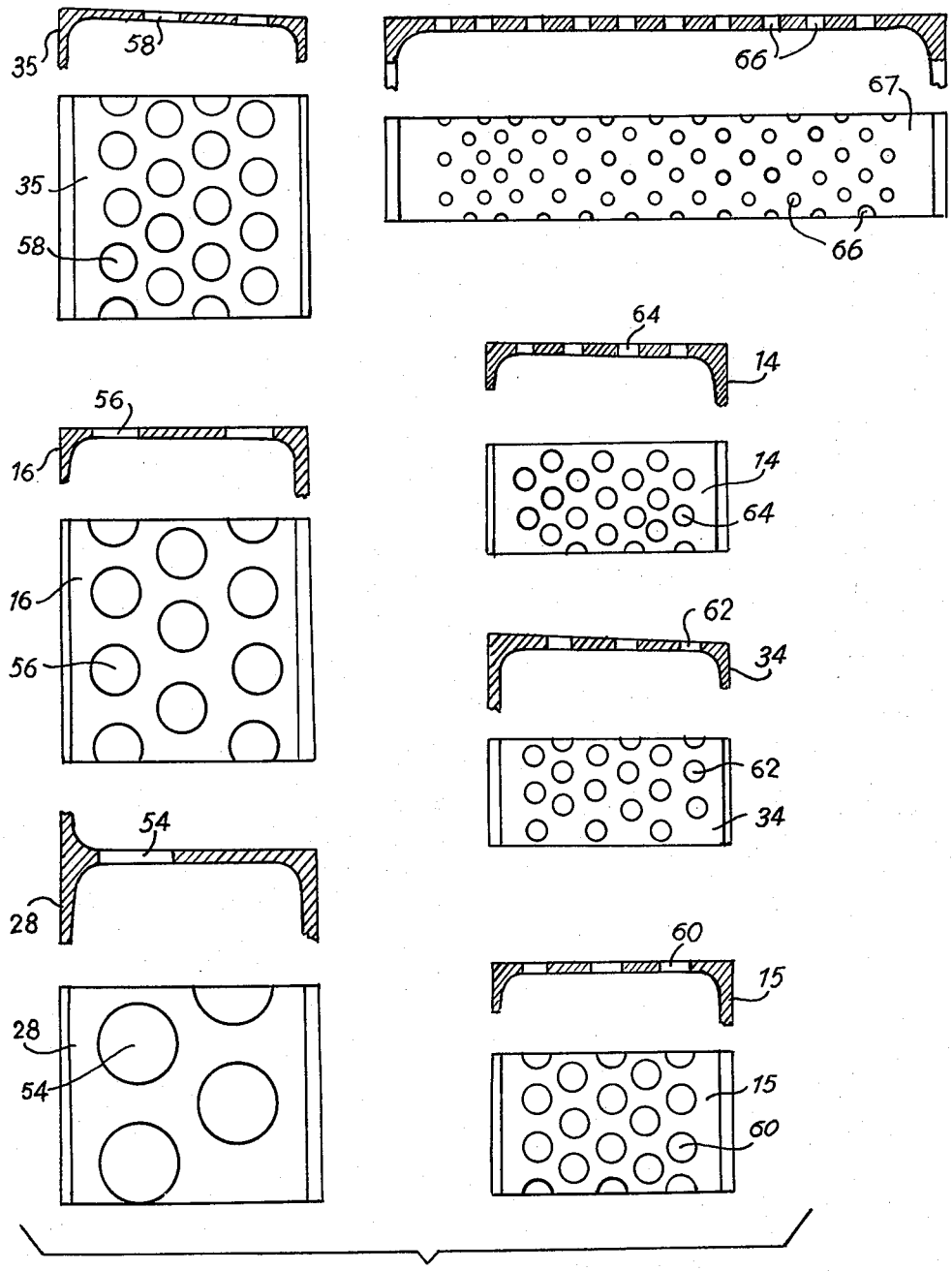
FIG. 4 is a fragmentary cross-sectional and disassembled view of the various grinding members of the grinder built in accordance with the present invention, showing the holes provided in each one of them.

More particularly, and as more clearly illustrated in FIG. 4 of the drawings, the first grinding members corresponding to the rotor moved by shaft assembly 3 and which are illustrated by means of reference numerals 28, 29, contain holes 54, 55 of the largest diameter and, proceeding towards the periphery, the grinding members 16, 19 contain holes 56, 57 of smaller diameter and so forth, decreasing from the center to the periphery, there are shown the holes 58, 59 corresponding to grinding members 35, 37, the holes 60, 61 corresponding to grinding members 15, 18, the holes 62, 63, corresponding to grinding members 34, 36, the holes 64, 65 corresponding to the grinding members 14, 17 and, finally, the holes 66 which are provided in the outer annular member of the outer rotor, illustrated by means of the reference numeral 67.

Figure 5:
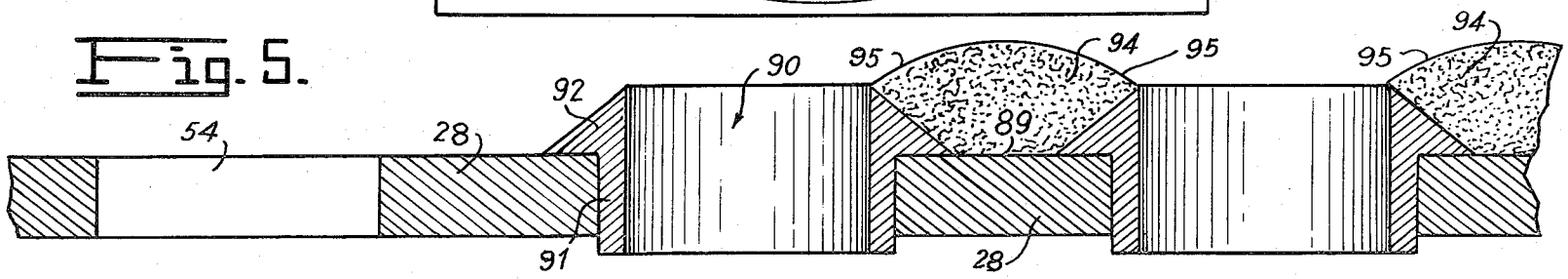
FIG. 5 is a fragmentary cross-sectional elevational view of one of the grinding members, showing the details of the holes and of the protecting bushings therefor.

All the above described holes, while perfectly capable of being mere bores, are preferably provided, in accordance with a particularly preferred embodiment of the invention, with protecting bushings 90 such as more clearly illustrated in FIG. 5 of the drawings. Said protecting bushings 90 are formed by a cylindrical section 91 provided with a radially outwardly directed frustoconical flange 92, such that, for instance, grinding member 28 particularly illustrated in FIG. 5 of the drawings, contains a surface 89 suitably protected by a temporary layer of material 94, inasmuch as the height of the protecting bushings 90 and particularly of the frustoconical flange 92 thereof, cause the building up of a thickness of material 94 between each one of the holes and on the surface 89 of grinding member 28. Said protecting action is effected by means of protecting bushings 90 provided in all the operative grinding members of the grinder of the present invention, inasmuch as, when the material 94 impacts against the surface 89 of the grinding members, said materials cannot be directly thrown through the holes such as the hole 54, because said holes are covered by their protecting bushings 90, and it is not until the suitable slope 95 is formed in the thickness of material 94 around each protective bushing 90, that said material 94 may be expelled outwardly and through the holes 54 as was described above. This, of course, represents a considerable advantage of the grinder built in accordance with the present invention, by virtue of the fact that the materials are not permitted to impact directly against the walls of the grinder but instead, all of said walls are suitably protected by thicknesses of material and the grinding action is effected only by impact between the particles of said material.

The operation of the grinder built in accordance with the above detailed description, which represents a preferred constructional embodiment of said grinder is as follows: The unground materials are fed, by means of suitable feed means, through the mouths 48, 49 of the outer housing 1 and are allowed to fall under the influence of gravity within the chutes 42, 44, which guide said materials towards the center of the grinder, diverting them by means of walls 50, 51, towards the interior of the openings 46, 47 of the rotor housing 2, wherefrom said materials pass to chambers 52, 53. The second rotor, by means of grinding members 28 and 29, rapidly rotating in a predetermined direction by virtue of the driving action caused by the hollow shaft assembly 4 moved by pulley 21, causes said unground materials to be thrown at a high speed and with a great force in the direction of rotation of said grinding members 28 and 29, thereby impacting against each other and against the layer of material built up in the inner surface of said grinding members 28, 29 and, in view of the centrifugal force caused by rotation, the said members force the preliminary ground materials to be thrown outwardly of the holes 54, 55 into the grinding chambers 69, 76. When the materials reach the grinding chambers 69, 76, said materials enter therein at a predetermined speed in the direction of rotation of the second rotor moved by the hollow shaft assembly 4 and impact against the layers of material previously built up on the inner walls of grinding members 16, 19, which are being rotated in the opposite direction and at an also high speed by means of disk 13 operated by the shaft assembly 3 and the pulley 20. The materials reaching the grinding chambers 69 and 76 are thrown in the opposite direction to that in which they entered into the chambers, such that the same particles of material impact with each other in the space and against the layers of material, whereby an effective grinding action by mere impacts of materials against materials and not by impacts of said materials against the working surfaces is accomplished, which provides the grinder built in accordance with the present invention with a considerably increased efficiency and with a very extended life.

The operation of the grinder is subsequently repeated from the center towards the periphery, inasmuch as the materials from chambers 69, 76, thrown by grinding members 16, 19, are centrifugally forced through the holes 58, 59 in order to enter the chambers 70, 77 wherein they are impacted against the materials rotating in the opposite direction and against material layers on the grinding members 35, 37, thereby accomplishing a further grinding action and so forth through the holes 58, 59, to enter chambers 71, 78 wherein a further grinding action is carried out, and hence through holes 60, 61 into chambers 72, 79 and then through holes 62, 63 into chambers 73, 80 in order to finally pass through holes 64, 65 to the last grinding chamber 74 which centrifugally ejects the ground materials through the member 67 and holes 66 thereof towards the discharge chamber 75. At the discharge chamber, the materials are thrown by centrifugal force through the openings 81, 82 into the chambers 83, 84 and hence are discharged from the grinder of the present invention with a very high fineness in view of the very high speed of impact provided by the oppositely rotating rotors which jointly produce considerable speeds which may even exceed the speed of sound at the periphery.

It may be seen from the above that for the first time a novel principle or system for grinding materials has been provided, which comprises alternately reversing the rotation of the materials to be ground in order to cause double speed impacts between the materials themselves and in order that the grinding action may be effected only by impacts exclusively between particles of the material thrown in opposite directions to achieve an impact speed which is nearly twice as great as the speed of rotation of the individual rotors. The provision of layers of suitable thickness of material on all the working surfaces of the grinder in accordance with the present invention, represents another considerable advantage, inasmuch as the grinding of the material will be exclusively effected by impact between the particles of material themselves and not between said particles of material and the parts of the grinder, whereby the latter will not be abraded as fast as it occurs with other types of prior art grinders. The impacts between the materials thrown against other materials and rotating in contrary senses, are very efficient because the impacting materials are of the same composition and, therefore, an alternating repetition of said impacts may accomplish a grinding of the materials with a very high efficiency until the required fineness is achieved, depending on the speed and the number of successive grinding chambers provided in the apparatus built in accordance with the present invention. The size of the grinder is considerably reduced in view of the fact that, by rotating the rotors in opposite directions and at similar speeds, said speeds are added up to provide an impact speed which is as mentioned above, about twice the rotational speed of the rotors, whereby the efficiency of the grinding operation is also increased to a very large extent.

The discharge of the material from the grinder built in accordance with the present invention, on the other hand, is of very simple execution and does not require any auxiliary discharging devices, inasmuch as the materials are thrown by a considerable centrifugal force outwardly of the apparatus without the need of said auxiliary system. On the other hand, the construction of the apparatus to provide the above described system is very simple and economic as will be apparent to any one skilled in the art, and the embodiment illustrated in the accompanying drawings and previously described must be regarded as only illustrative but not limitative of the present invention, inasmuch as the grinder may be subject to considerable changes in the constructional details thereof. For instance, the grinder may be arranged in vertical as well as in horizontal position indistinctly, the grinding members may be driven through a drive different from the one shown and described above, as long as they are alternately rotated in opposite directions, and the shape of the housings, of the loading chutes and of the discharge chamber may be also changed within the true spirit of the present invention.

Although certain specific embodiments have been shown and described above, it is to be understood that many modifications thereof are possible. The present invention, therefore, is not to be restricted except insofar as is necessitated by the prior art and by the spirit of the appended claims.

What is claimed is:

1. An apparatus for grinding materials comprising:

a cylindrical housing;

first rotor means within said housing;

a plurality of first concentrical channel-like annular flanged grinding members carried by said first rotor means, each having an annular element and a pair of flanges extending from each side edge of said annular element, radially inwardly thereof;

second rotor means within said housing;

a plurality of second concentrical channel-like annular flanged grinding members carried by said second rotor means, each having an annular element and a pair of flanges extending from each side edge of said annular element, radially inwardly thereof, said plurality of second concentrical grinding members comprising an innermost or center member, an outermost or peripheral member, and at least one intermediate member, each one of said first grinding members being arranged concentrically between a pair of said second grinding members for forming closed grinding chambers therebetween, a plurality of holes distributed throughout said annular elements, said holes having a decreasing size from one grinding member to the next from the center to the periphery of the housing;

first drive means for rotating said first rotor means in a predetermined direction;

second drive means for rotating said second rotor means in the opposite direction;

feed means for feeding material to be ground into said innermost grinding member; and discharge chamber means for receiving ground material passing through the holes of the annular element of said outermost grinding member and for discharging said ground material outwardly of the apparatus, wherein said first drive means comprises a shaft assembly comprising two coaxial shafts extending toward both ends of the center of said first rotor means, bearing means for supporting said shaft assembly on both ends thereof, and a pulley arranged on one of the shafts of said shaft assembly at the outermost part thereof in order to receive the driving action of a suitable motor; and said second drive means comprises a hollow shaft assembly comprising two coaxial hollow shafts, concentrically arranged around said first shaft assembly, each one of said coaxial hollow shafts being joined to each one of said parallel disks of said second rotor means, and a pulley provided on one of said coaxial hollow shafts in a position opposite to the first above mentioned pulley, the other of said coaxial hollow shafts being of a sufficiently short length to provide for the mounting of the pulley of the shaft of the first rotor means, said holes of the annular flanged grinding members comprising bushings, said bushings having a cylindrical member passing through said hole and a frustoconical extension outwardly directed therefrom and extending to a distance outwardly of the inner face of each hole of each grinding member such that, when the materials impact against the inner surface of the grinding members, said extensions cause the building up of a thickness of material to form layers of said material around each bushing, in order to avoid impact of materials against the walls of the said grinding members.

2. An apparatus for grinding materials according to claim 1, wherein said second grinding members comprise a plurality of intermediate members, wherein said first rotor means comprises a rotatable central disk for supporting one of the flanges of each one of said first grinding members, said first grinding members being arranged in two oppositely outwardly directed arrays supported by said central disk; and wherein said second rotor means comprises two rotatable side disks spaced from and parallely arranged at each side of said central disk, said plurality of intermediate grinding members being arranged in two inwardly directed arrays, each one supported by each side disk through one of their flanges, spacing of said side disks from said central disk being such that said arrays of first grinding members and said arrays of second grinding members are overlapped to form said grinding chambers, said outermost and said innermost grinding members bounding said grinding chambers to form a unitary assembly.

3. An apparatus for grinding materials according to claim 1 or 2 wherein said feed means comprises a chute for guiding the material toward an opening which discharges the same into a central grinding chamber, said central grinding chamber being formed by the innermost one of said annular flanged grinding members, and the rotor means being provided with said opening to introduce the materials into said central grinding chamber.

4. An apparatus for grinding materials according to claim 3, wherein said discharge chamber means comprises the peripheral wall of said cylindrical housing for said rotor means, sidewardly directed circular openings having a diameter slightly larger than said rotor means being provided in said cylindrical housing, in order to provide for the discharge of materials that are thrown centrifugally by the outermost one of said annular flanged grinding members.

* * * * *